US006814628B2

(12) United States Patent
Chadbourne

(10) Patent No.: US 6,814,628 B2
(45) Date of Patent: Nov. 9, 2004

(54) MODULAR LUG BLOCK ASSEMBLY

(75) Inventor: Richard Chadbourne, Merrimack, NH (US)

(73) Assignee: FCI Americas Technology, Inc., Reno, NV (US)

( * ) Notice: Subject to any disclaimer, the term of this patent is extended or adjusted under 35 U.S.C. 154(b) by 400 days.

(21) Appl. No.: 09/892,901

(22) Filed: Jun. 27, 2001

(65) Prior Publication Data

US 2003/0003812 A1 Jan. 2, 2003

(51) Int. Cl.[7] ..... H01R 11/09
(52) U.S. Cl. ..... 439/723; 439/717
(58) Field of Search ..... 439/723, 717, 439/814, 718, 797, 798, 908, 709

(56) References Cited

U.S. PATENT DOCUMENTS

| | | | | | |
|---|---|---|---|---|---|
| 2,431,999 | A | | 12/1947 | Engelhardt | 339/328 |
| 2,892,176 | A | * | 6/1959 | Gordon | 439/717 |
| 3,474,383 | A | * | 10/1969 | Mahon et al. | 439/717 |
| 4,040,711 | A | * | 8/1977 | Waddington et al. | 439/797 |
| 4,050,770 | A | | 9/1977 | Rigo | 339/198 |
| 4,983,132 | A | | 1/1991 | Weidler | 439/786 |
| 5,107,396 | A | | 4/1992 | Rosen et al. | 361/355 |
| 5,122,072 | A | | 6/1992 | Arn et al. | 439/210 |
| 5,183,971 | A | | 2/1993 | Lafosse et al. | 174/138 F |
| 5,586,905 | A | | 12/1996 | Marshall et al. | 439/463 |
| 5,632,647 | A | | 5/1997 | Dobbin et al. | 439/521 |
| 6,129,595 | A | | 10/2000 | Scanlon et al. | 439/716 |
| 6,160,696 | A | | 12/2000 | Baily et al. | 361/115 |
| 6,497,592 | B1 | | 12/2002 | Beadle | 439/814 |

* cited by examiner

*Primary Examiner*—Hae Moon Hyeon
(74) *Attorney, Agent, or Firm*—Harrington & Smith, LLP

(57) ABSTRACT

An electrical power connection block housing including a first housing piece and a second housing piece. The first housing piece forms at least a portion of a first exterior side of the block housing. An interior side of the first housing piece has a first slot shaped bus bar mounting area. The second housing piece is connected to the first housing piece. The second housing piece has a portion with a first side located directly opposite the interior side of the first housing piece and a second slot shaped bus bar mounting area on the first side of the second housing piece. The first and second housing pieces form a first bus bar receiving area with the first and second bus bar mounting areas located generally opposite each other on opposite sides of the receiving area for capturing a bus bar therebetween.

28 Claims, 10 Drawing Sheets

MODULAR LUG BLOCK ASSEMBLY

BACKGROUND OF THE INVENTION

1. Field of the Invention

The present invention relates to electrical connectors and, more particularly, to an electrical connection block assembly.

2. Brief Description of Prior Developments

Power stud blocks are generally known in the art. For example, Marathon Special Products sells 600 Volt power stud blocks under the catalog numbers 1422122 and 1423122. Power stud blocks are generally used for AC or DC power distribution, such as for a DC circuit in a telecom application. Power stud blocks can be provided in two pole or three poll configurations.

There is a desire to provide an electrical power connection block which is smaller in size than conventional electrical power connection blocks. There is also a desire to provide an electrical power connection block which has modular components to allow multiple different types of connection blocks to be manufactured with use of common components.

SUMMARY OF THE INVENTION

In accordance with one aspect of the present invention, an electrical power connection block housing is provided including a first housing piece and a second housing piece. The first housing piece forms at least a portion of a first exterior side of the block housing. An interior side of the first housing piece has a first slot shaped bus bar mounting area. The second housing piece is connected to the first housing piece. The second housing piece has a portion with a first side located directly opposite the interior side of the first housing piece and a second slot shaped bus bar mounting area on the second side of the second housing piece. The first and second housing pieces form a first bus bar receiving area with the first and second bus bar mounting areas located generally opposite each other on opposite sides of the receiving area for capturing a bus bar therebetween.

In accordance with another aspect of the present invention, an electrical power connection block housing is provided including a first housing piece, a second housing piece, and a third housing piece. The first housing piece forms at least a portion of a first side of the block housing. The first housing piece has a first interlock connection section. The second housing piece has a first side with a second interlock connection section directly interconnected with the first interlock connection section and a second side with a third interlock connection section. The third housing piece has a first side with a fourth interlock connection section directly interconnected with the third interlock connection section. The housing pieces form bus bar receiving areas therebetween. The first and third interlock connection sections are substantially a same size and shape.

In accordance with one method of the present invention, a method of assembling an electrical power connection block assembly is provided including steps of locating electrical bus bars between pairs of housing pieces of the connection block, a middle one of the housing pieces having two of the bus bars located against opposite respective sides of the middle housing piece; and intermeshing mating projections and recesses of the housing pieces with adjacent housing pieces to interlock the housing pieces with each other.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
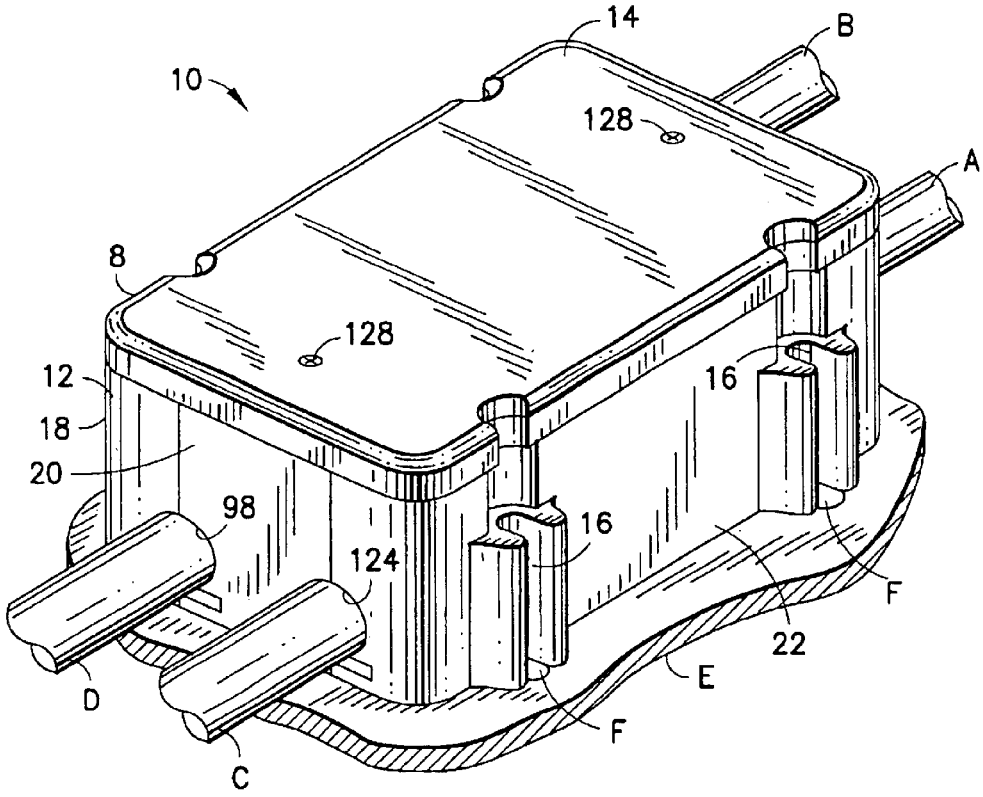
FIG. 1 is a top, front and right side perspective view of an electrical connection block assembly incorporating features of the present invention shown connected to electrical conductors and located on another member.

Referring to FIG. 1, there is shown a perspective view of an electrical power connection block assembly 10 incorporating features of the present invention shown attached to electrical conductors A, B, C and D and located on top of a mounting member E. Although the present invention will be described with reference to the embodiments shown in the drawings, it should be understood that the present invention can be embodied in many alternate forms of embodiments. In addition, any suitable size, shape or type of elements or materials could be used.

Figure 3:
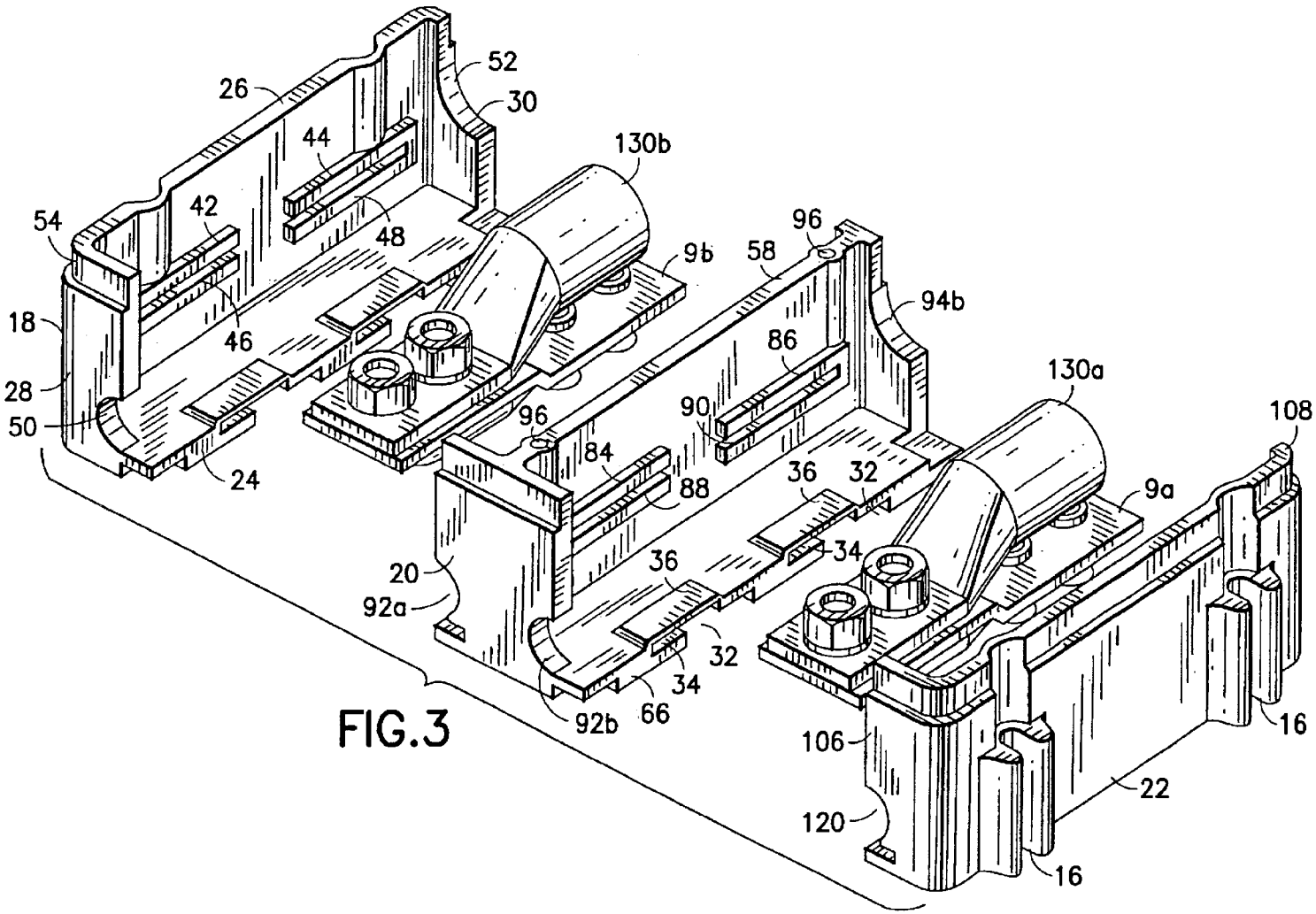
FIG. 3 is an exploded perspective view of some of the components of the assembly shown in FIG. 2.

The block assembly 10 generally comprises a housing 8 and electrical bus bars 9*a*, 9*b* (see FIG. 3; also referred to as bus bars 9). The housing 8 generally comprises a container 12 and a cover 14. However, in an alternate embodiment, the cover might not be provided. In the embodiment shown, the block assembly 10 is a two pole block assembly. However, as described below, features of the present invention can be incorporated into a three or more poll block assembly. In the embodiment shown, the block assembly 10 is for a DC power distribution circuit. However, in an alternate embodiment, the present invention could be used as an AC power distribution circuit.

Conductors A and C are connected to each other inside the block assembly 10 by bus bar 9*a* and are connected to supply electricity from a battery. Conductors B and D are connected to each other inside the block assembly 10 by bus bar 9*b* and are connected as a return to the battery. However, the conductors A–D could be connected to any suitable components. In addition, more or less than four conductors could be connected by the block assembly.

The mounting member E could be any suitable type of component, such as a metal sheet member. The mounting member E comprises holes F therethrough. Fasteners (not shown) such as screws can be used to fixedly attach the block assembly 10 to the mounting member E by being screwed into the holes F and being located in the fastener receiving areas 16 of the container 12. However, In alternate embodiments, any suitable type of system for mounting the block assembly 10 to another component could be provided.

Referring also to FIGS. 2-7, the container 12 generally comprises three housing pieces 18, 20 and 22. However, in alternate embodiments, the container 12 could be comprised of more or less than three housing pieces. The first and third housing pieces 18, 22 are substantially mirror images of each other except at their bottom sections as will be described in further detail below. The first and third housing pieces 18, 22 form the outer sides of the container 12. The first housing piece 18 forms a left side. The third housing piece 22 forms a right side. The terms "right", "left", "top", "bottom", "front" and "rear" are used herein for reference only. The second housing piece 20 is sandwiched between the first and third housing pieces. Thus, the second housing piece 20 forms a middle piece of the container 12.

The first housing piece 18 generally comprises a bottom section 24, a side section 26, a front section 28 and a rear section 30. The bottom section 24 comprises a first interlock connection section 25. As seen best in FIG. 6, the first interlock connection section 25 comprises a side edge of the bottom section 24 having two pairs of bottom slots 32, top slots 34, and cover sections 36. However, more or less than two pairs could be provided. In addition, the first interlock connection section could have any suitable type of size or shape. For example, rather than molding the cover section 36 over the top slot, a piece of non-integrally-molded flat insulating material can be placed over the top slot.

In the embodiment shown, the top slots 34 are located over the bottom slots 32. The bottom slots 32 extend into the side edge a further distance than the top slots 34. The top and bottom slots are connected to each other, but the top and bottom slots or partially horizontally offset from each other in each pair. The cover sections 36 are located over the top slots 34. In an alternate embodiment the cover sections 36 might not be provided. Front and rear ends of the bottom section 24 also comprise slots 38, 40.

The side section 26 has an interior facing side which comprises a bus bar mounting area. In the embodiment shown, the bus bar mounting area generally comprises a first projection 42 and a second projection 44. The first projection 42 has a general C shape and extends inward from the interior side. The second projection has a general reversed C shape and extends inward from the interior side. In the embodiment shown, the first and second projections are partially vertically offset from each other.

The C shape and reversed C shape each form a slot 46, 48 which are vertically offset from each other. The slots 46, 48 form receiving areas for one of the side edges of one of the bus bars 9*a*, 9*b* as will be described in further detail below. In alternate embodiments, the bus bar mounting areas could have any suitable type of shape. For example, the bus bar mounting area might not comprise projections, but instead could comprise recessed slots. Alternatively, the projections could have any suitable type of shape, so long as the bus bar mounting area is adapted to receive a side edge of the bus bar 9. An exterior side of the first housing piece 18 at the side section 26 comprises the fastener mounting areas 16. The front section 28 comprises a recess 50. The rear section 30 comprises a recess 52. The top side of the side section 26, front section 28 and rear section 30 form part of a cover mounting lip 54 (see FIGS. 2 and 4).

Figure 5:
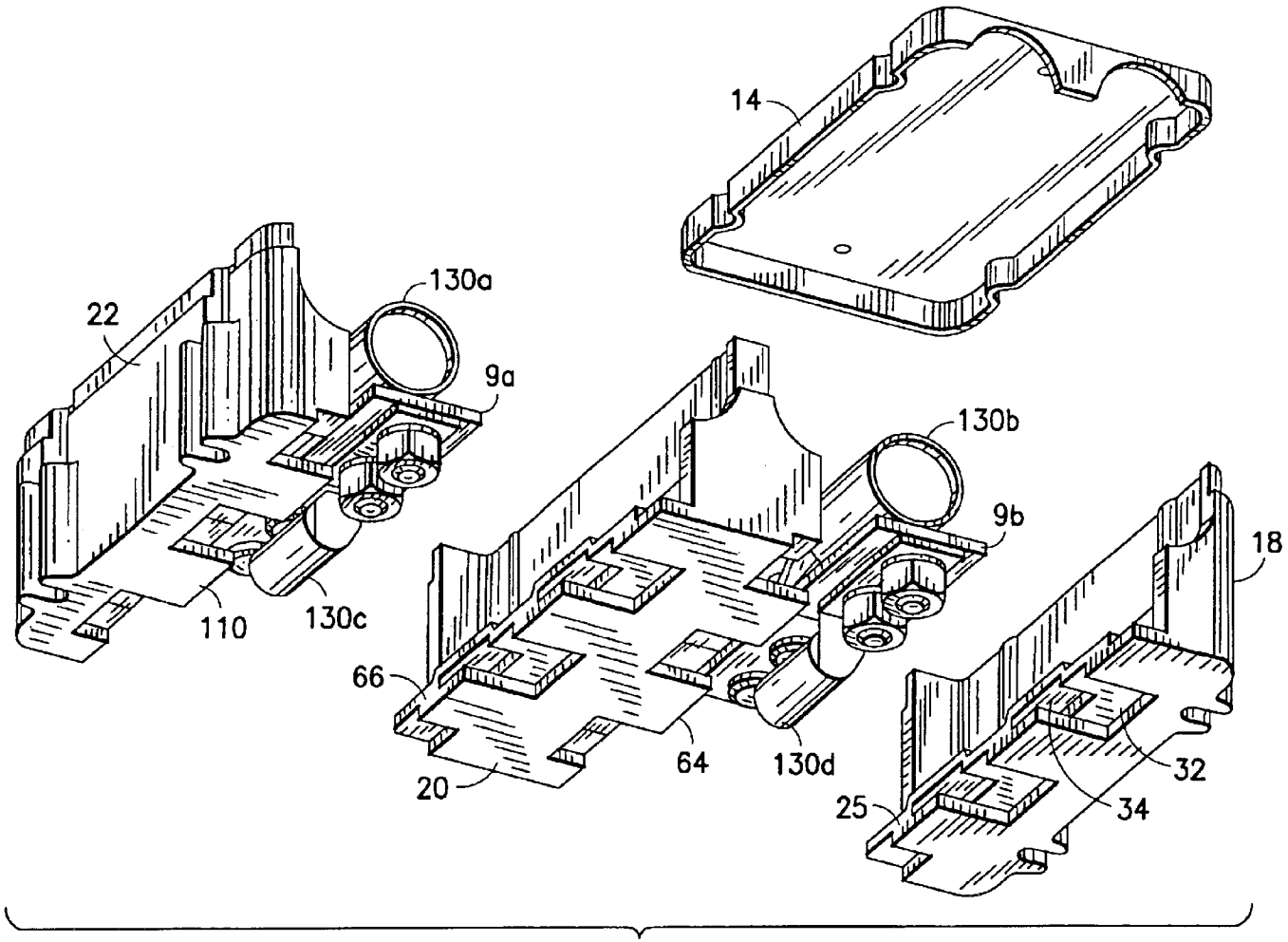
FIG. 5 is an exploded bottom, rear and right side perspective view of the components of the assembly shown in FIG. 2.
Figure 6:
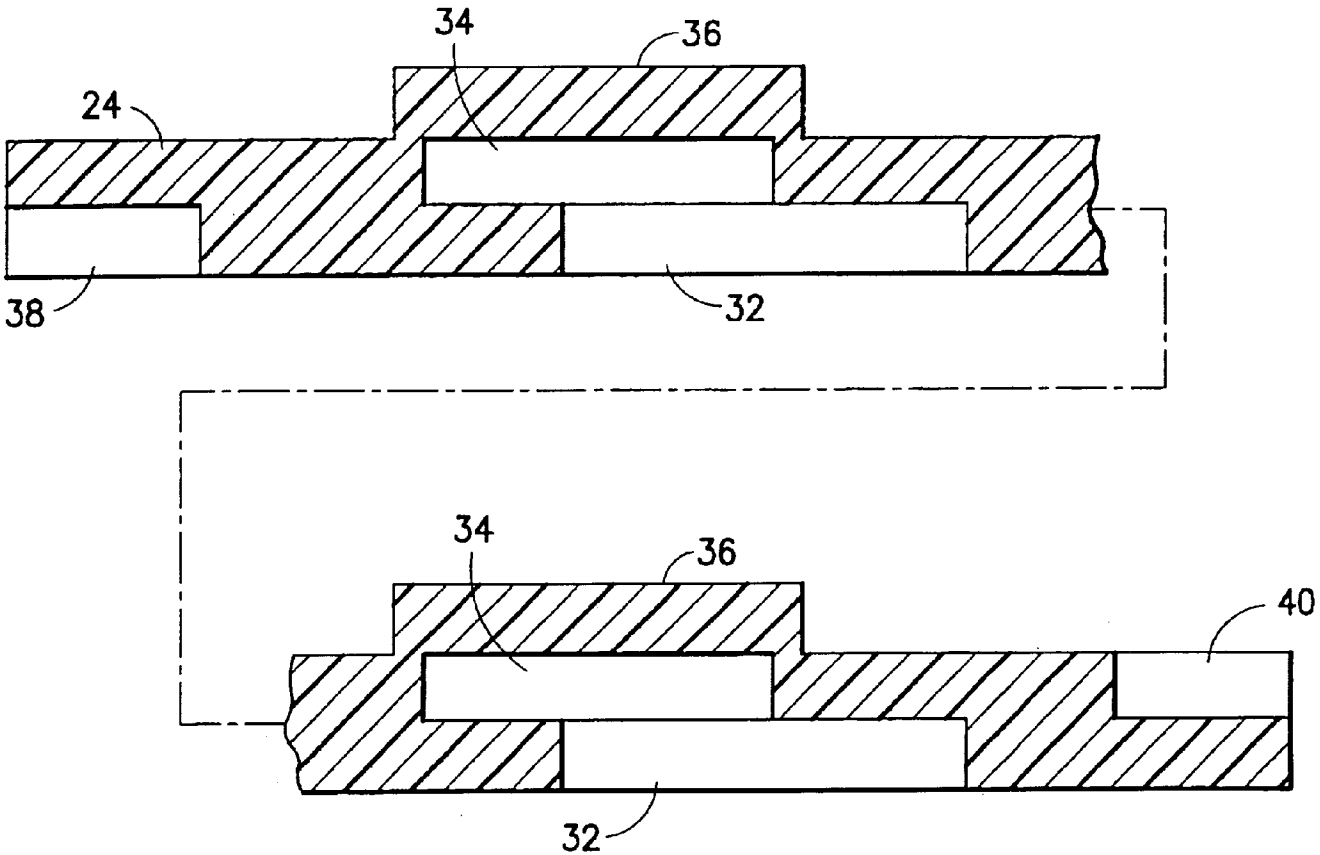
FIG. 6 is a cross sectional view of the first interlock connection section of the first housing piece.
Figure 7:
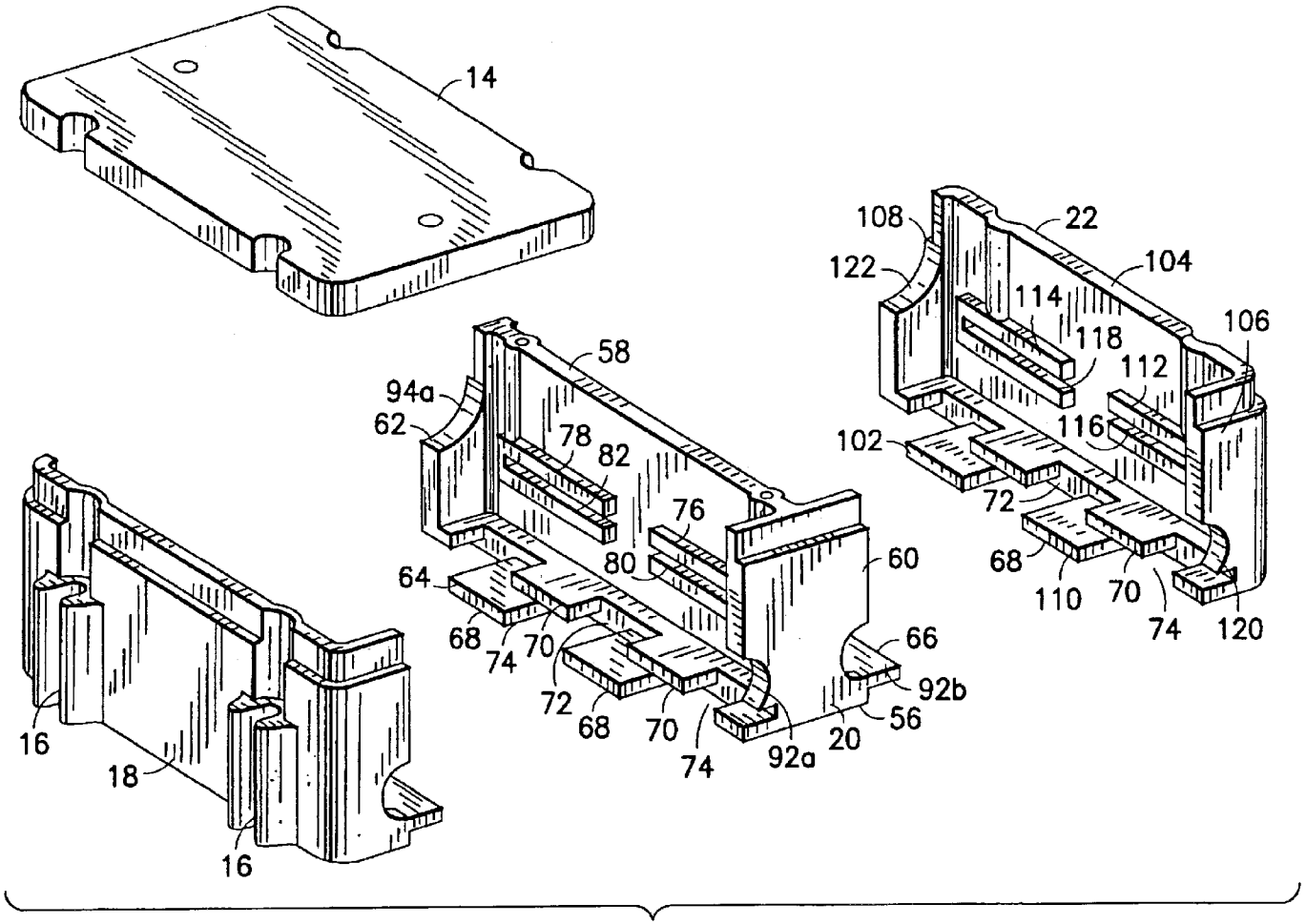
FIG. 7 is an exploded top, left side and front side perspective view of the housing.

As best seen in FIGS. 3, 5 and 7, the second housing piece 20 generally comprises a bottom section 56, a middle section 58, a front section 60 and a rear section 62. The bottom section 56 comprises a second interlock connection section 64 and a third interlock connection section 66. The third interlock connection section 66 is substantially identical to the first interlock connection section 25. However, in alternate embodiments, the first and third interlock connection sections could have different sizes or shapes. As seen best in FIG. 3, the third interlock connection section 66 comprises a side edge of the bottom section 56 having two pairs of bottom slots 32, top slots 34, and cover sections 36. However, more or less than two pairs could be provided. In addition, the third interlock connection section could have any suitable type of size or shape.

The second interlock connection section 64 comprises a side edge of the bottom section 56 having two pairs of bottom projections 68, top projections 70 and, recesses 72, 74 between the pairs. However, more or less than two pairs could be provided. In addition, the second interlock connection section could have any suitable type of size or shape. In the embodiment shown, the top projections 70 are located over the bottom projections 68. The bottom projections 68 extend outward at the side edge a further distance than the top projections 70. The top and bottom projections are partially horizontally offset from each other in each pair. The second interlock connection section 64 is sized and shaped to mate with the first interlock connection section 25.

The middle section 58 has a side which faces the first housing piece 18 which comprises a bus bar mounting area. In the embodiment shown, the bus bar mounting area generally comprises a first projection 76 and a second projection 78. The first projection 76 has a reversed general C shape and extends from the side. The second projection has a general C shape and extending from the side. In the embodiment shown, the first and second projections are partially vertically offset from each other. The C shape and reversed C shape form slots 80, 82 which are vertically offset from each other. The slots 80, 82 form receiving areas for one of the side edges of one of the bus bars 9 as will be described in further detail below.

As seen best in FIG. 3, the middle section 58 also has an opposite side which comprises a bus bar mounting area and which faces the third housing piece 22. In the embodiment shown, the bus bar mounting area on the opposite side generally comprises a first projection 84 and a second projection 86. The first projection 84 has a general C shape and extends outward from the side. The second projection has a general reversed C shape and extends outward from the side. In the embodiment shown, the first and second projections are partially vertically offset from each other.

The C shape and reversed C shape each form a slot 88, 90 which are vertically offset from each other. The slots 88, 90 form receiving areas for one of the side edges of one of the bus bars 9 as will be described in further detail below. In alternate embodiments, the bus bar mounting areas could have any suitable type of shape. For example, the bus bar mounting area might not comprise projections, but instead could comprise recessed slots. Alternatively, the projections could have any suitable type of shape, so long as the bus bar mounting area is adapted to receive a side edge of the bus bar 9. The lateral sides of the front and rear ends of the bottom section 56 also comprises slots and projections.

The front section 60 comprises two recesses 92*a*, 92*b*. The rear section 62 comprises two recesses 94*a*, 94*b*. The top side of the front section 60 and rear section 62 form part of the cover mounting lip 54. The middle section 58 has fastener holes 96 into its top side. As seen with reference to FIGS. 1 and 2, when the second housing piece 20 is connected to the first housing piece 18, the recesses 50 and 92*a* form an aperture 98 which allows the conductor D to pass through the housing 8. Likewise, the recesses 52 and 94*a* form an aperture 100 which allows the conductor B to pass through the housing 8.

The third housing piece 22 generally comprises a bottom section 102, a side section 104, a front section 106 and a rear section 108. The bottom section 102 comprises a fourth interlock connection section 110. The fourth interlock connection section 110 is substantially identical to the second interlock connection section 64. However, in alternate embodiments, the second and fourth interlock connection sections could have different sizes and shapes.

As seen best in FIG. 7, the fourth interlock connection section comprises a side edge of the bottom section 102 having two pairs of bottom projections 68, top projections 70 and, recesses 72, 74 between the pairs. However, more or less than two pairs could be provided. In addition, the fourth interlock connection section could have any suitable type of size or shape. In the embodiment shown, the top projections 70 are located over the bottom projections 68. The bottom projections 68 extend outward at the side edge a further distance than the top projections 70. The top and bottom projections are partially horizontally offset from each other in each pair. The fourth interlock connection section 110 is sized and shaped to mate with the third interlock connection section 66.

The side section 104 has an interior facing side which comprises a bus bar mounting area. The bus bar mounting area on the side section 104 is substantially identical to the bus bar mounting area on the side of the middle section 58 of the middle housing piece 20 which faces the first housing piece 18. However, in alternate embodiments, the two bus bar mounting areas could have different sizes and shapes.

In the embodiment shown, the bus bar mounting area in the side section 104 generally comprises a first projection 112 and a second projection 114. The first projection 112 has a general C shape and extends inward from the interior side. The second projection 114 has a general reversed C shape and extends inward from the interior side. In the embodiment shown, the first and second projections are partially vertically offset from each other. The C shape and reversed C shape each form a slot 116, 118 which are vertically offset from each other. The slots 116, 118 form receiving areas for one of the side edges of one of the bus bars 9 as will be described in further detail below.

In alternate embodiments, the bus bar mounting area on the side section 104 could have any suitable type of shape. For example, the bus bar mounting area might not comprise projections, but instead could comprise recessed slots. Alternatively, the projections could have any suitable type of shape, so long as the bus bar mounting area is adapted to receive a side edge of the bus bar 9. An exterior side of the third housing piece 22 at the side section 104 comprises the fastener mounting areas 16. The front section 106 comprises a recess 120. The rear section 108 comprises a recess 122. The top side of the side section 104, front section 106 and rear section 108 form part of the cover mounting lip 54. As seen with reference to FIGS. 1 and 2, when the second housing piece 20 is connected to the third housing piece 22, the recesses 92*b* and 120 form an aperture 124 which allows the conductor C to pass through the housing 8. Likewise, the recesses 94*b* and 122 form an aperture 126 which allows the conductor A to pass through the housing 8.

Figure 2:
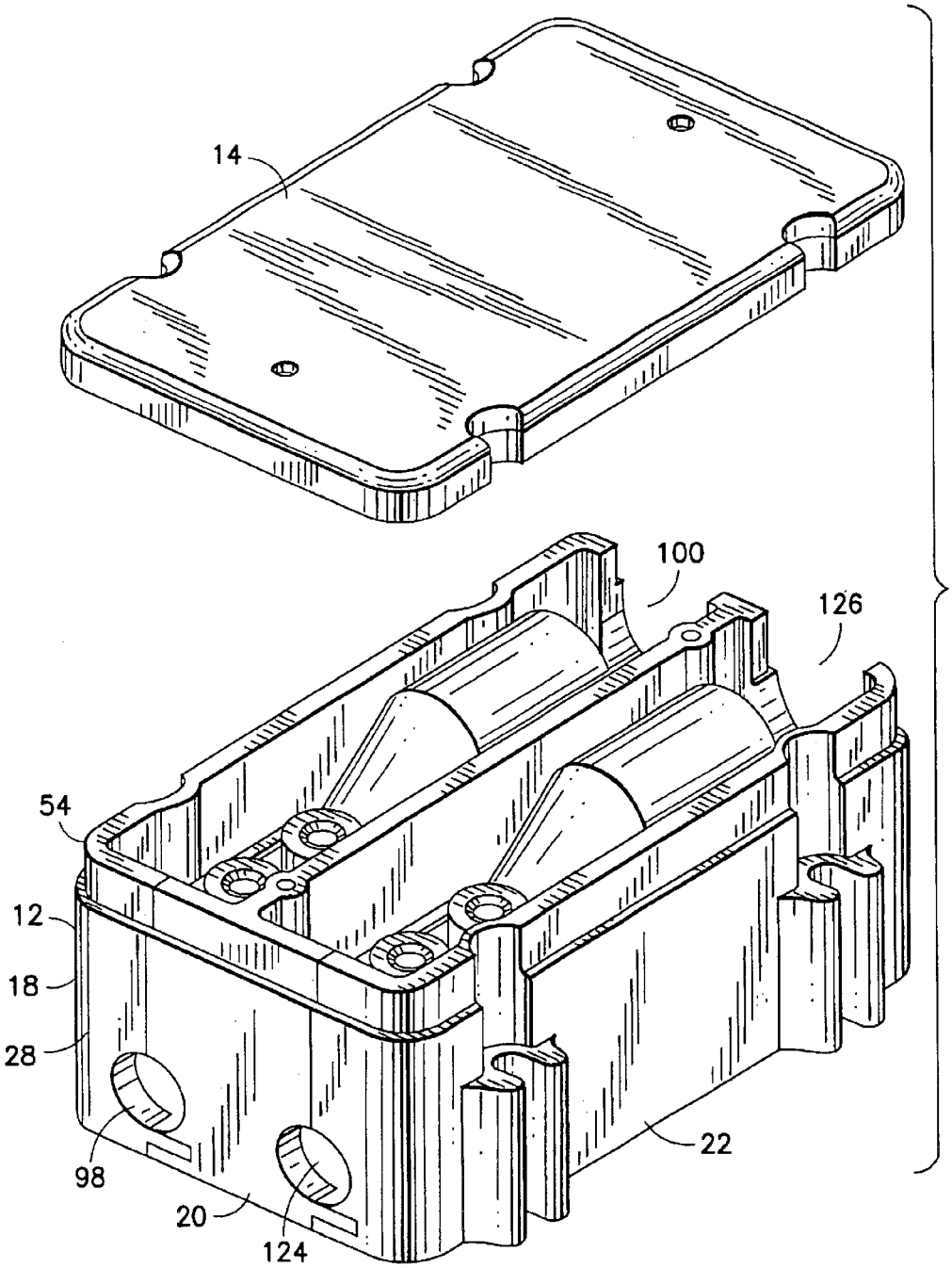
FIG. 2 is a top, front and right side perspective view of the assembly shown in FIG. 1 without the electrical conductors and with the cover located in an exploded position.
Figure 4:
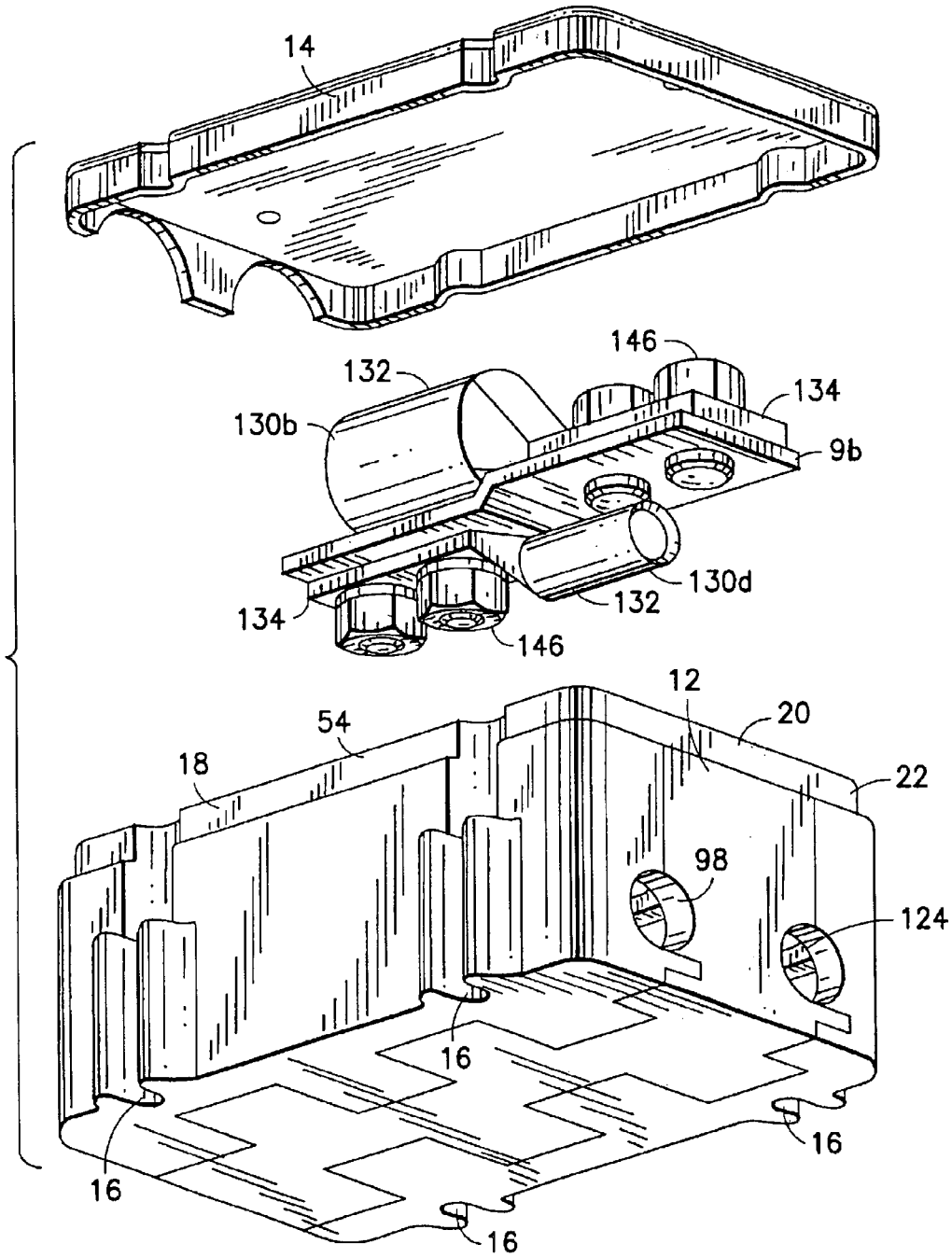
FIG. 4 is an exploded bottom, front and left side perspective view of some of the components of the assembly shown in FIG. 2.

The housing pieces 18, 20 and 22 are adapted to be assembled to each other as shown in FIGS. 1, 2 and 4. The first interlock connection section 25 and the second interlock connection section 64 matingly interlock with each other. Likewise, the third interlock connection section 66 and the fourth interlock connection section 110 matingly interlock with each other. This forms the container 12. The cover 14 can be placed on the container lip 54 and fasteners 128 (see FIG. 1) can fixedly attach the cover 14 to the center section 58 of the middle piece 20. However, the cover 14 might not be provided. The housing pieces 18, 20 and 22 are preferably retained with each other by fasteners (not shown) located in the fastener receiving areas 16 and attached to the member E. However, in alternate embodiments, any suitable means could be provided for fixedly retaining the housing pieces with each other separate from the member E, such as the cover 14 for example.

Before the housing pieces 18, 20 and 22 are attached to the member E, the conductors A–D or preferably attached to connectors 130*a*–130*d* which, in turn, are fixedly attached to the bus bars 9. The connectors 130*a*–130*d* generally comprise a first section 132 and a second section 134. The first section 132 is adapted to be crimped or compressed onto one of the conductors A–D. The second section 134 as holes therethrough for mounting on posts of the bus bars 9. However, in alternate embodiments, the block assembly 10 could be used with conductors having any suitable type or shape of connectors thereon.

Figure 8:
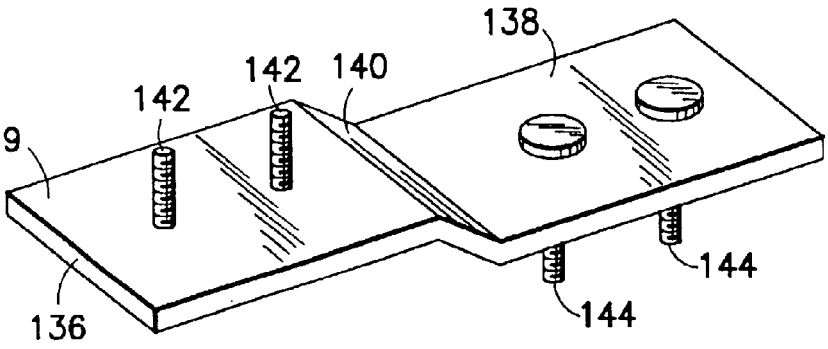
FIG. 8 is a perspective view of one of the bus bars used in the assembly shown in FIG. 2.

Referring also to FIG. 8, each bus bar 9 generally comprises a first section 136, a second section 138, and a connecting section 140. In alternate embodiments, the bus bars could be different from each other. The first section 136 comprises fastening posts 142. The second section 138 comprises fastening posts 144. The fastening posts 142 extend in an opposite direction from the fastening posts 144. Although the embodiment shown shows two fastening posts for each of the first and second sections 136, 138, each section might comprise more or less than two fastening posts. In addition, rather than fastening posts, the bus bar could comprise any suitable means for fixedly and stationarily attaching the connectors 130 thereto.

Figure 10:
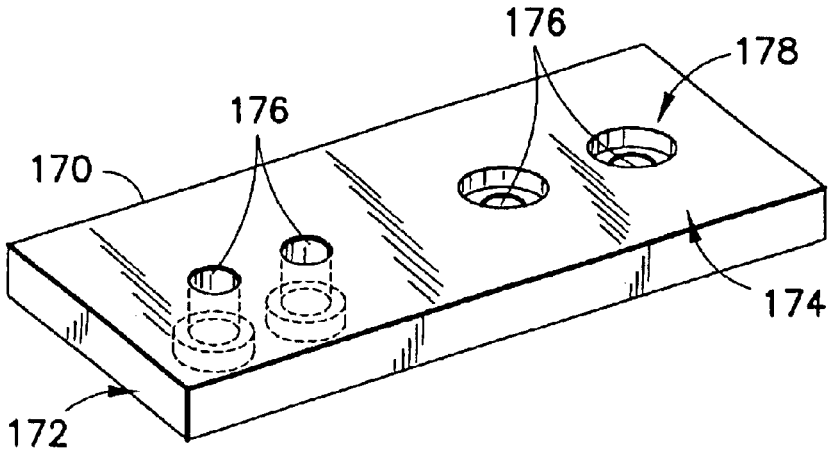
FIG. 10 is a perspective view of an alternate embodiment of the bus bar shown in FIG. 8.
Figure 11:
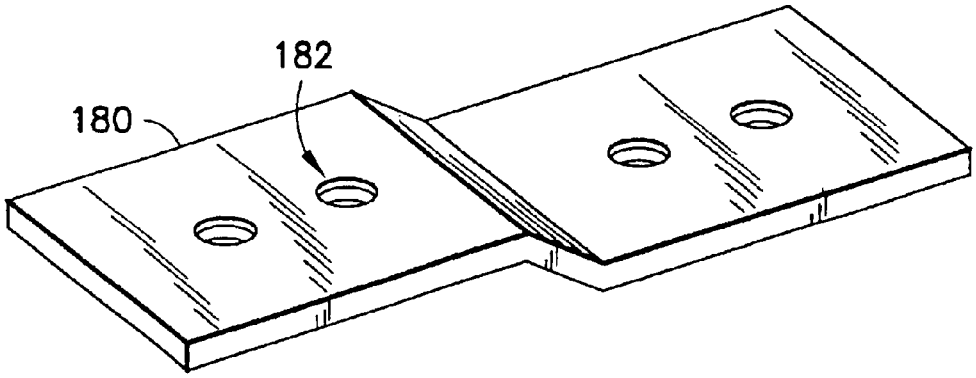
FIG. 11 is a perspective view of another alternate embodiment of the bus bar shown in FIG. 8.

One alternate embodiment of the bus bar is shown in FIG. 10. In this alternate embodiment, the bus bar 170 comprises a flat block of stock material with two sets 172, 174 of fastener mounting holes 176. The fastener holes have enlarged counter-bored sections 178 which are adapted to receive a head of a fastener, such as a stud or screw, for clearance. Each set 172, 174 has its counter-bored sections 178 on opposite sides of the bus bar. Another alternate embodiment of the bus bar is shown in FIG. 11. In this embodiment the bus bar 180 has tapped or threaded holes 182. This allows the use of screws or bolts instead of nuts on studs.

In the embodiment shown, the first section 136 is vertically offset from the second section 138. The connecting section 140 connects the first section 136 with the second section 138. In this embodiment, the first section 136, second section 138 and connecting section 140 form a general Z shape. However, in alternate embodiments, the sections could form the bus bar in any suitable type of shape. For example, the first and second sections 136, 138 might not be vertically offset from each other. The first and second sections could have notches on their respective top and bottom sides. Alternatively, the first and second sections could have raised sections on their respective top and bottom sides for receiving the second sections 134. For such alternatives embodiments, the slots in each of the bus bar mounting areas might not be vertically offset from each other.

The second sections 134 of the connectors 130 are mounted on the posts 142, 144 and the nuts 146 are attached to the posts 142, 144 to fixedly and stationarily attach the connectors 130 to the bus bars 9. As seen best in FIGS. 4 and 5, the connectors 130*a* and 130*b* are located on top sides of the bus bars 9 and extend towards the rear ends of the bus bars. The connectors 130*c* and 130*d* are located on bottom sides of the bus bars 9 and extend towards the front ends of the bus bars. These connections could be made in a factory the housing pieces being mounted on the piece of equipment E with screws in cavities 16. Conductors A and B could be installed during equipment installation when the electrical power is connected.

With the conductors A–D attached to the connectors 130, and the connectors 130 attached to the bus bars 9*a*, 9*b*, the bus bars 9 are placed between the housing pieces 18, 20 and 22. The housing pieces 18, 20 and 22 are then assembled to each other. During assembly, side edges of the bus bars 9 are received in the slots of the bus bar mounting areas in the housing pieces. The two slots 46 and 80 are located directly opposite each other. The two slots 48 and 82 are located directly opposite each other. The two slots 88 and 116 are located directly opposite each other. The two slots 90 and 188 are located directly opposite each other.

A right side edge of the right bus bar 9*a* is located in the bus bar receiving area of the third housing piece 22. More specifically, the right side edge of the first section 136 is located in the slot 116, the right side edge of the second section 138 is located in the slot 118, and the right side edge of the connecting section 140 is located between the two projections 112, 114. A left side edge of the bus bar 9*a* is located in the right side bus bar receiving area of the second housing piece 20. More specifically, the left side edge of the first section 136 is located in the slot 88, the left side edge of the second section 138 is located in the slot 90, and the left side edge of the connecting section 140 is located between the two projections 84, 86. This stationarily traps the bus bar 9*a* between the housing pieces 20, 22 at a predetermined fixed location. The top and bottom sides of the bus bar 9*a* and connectors 130*a*, 130*c* are spaced a predetermined distance from the top and bottom sides of the housing 8 to provide a predetermined air clearance.

A left side edge of the left bus bar 9*b* is located in the bus bar receiving area of the first housing piece 18. More specifically, the left side edge of the first section 136 is located in the slot 46, the left side edge of the second section 138 is located in the slot 48, and the left side edge of the connecting section 140 is located between the two projections 42, 44. A right side edge of the bus bar 9*b* is located in the left side bus bar receiving area of the second housing piece 20. More specifically, the right side edge of the first section 136 is located in the slot 80, the right side edge of the second section 138 is located in the slot 82, and the right side edge of the connecting section 140 is located between the two projections 76, 78. This stationarily traps the bus bar 9*b* between the housing pieces 18, 20 at a predetermined fixed location. More specifically, the top and bottom sides of the bus bar 9*b* and connectors 130*b*, 130*d* are spaced a predetermined distance from the top and bottom sides of the housing 8 to provide a predetermined air clearance. The top connectors 130*a*, 130*b* can also be removed from the bus bars 9 without removing the bus bars from their connection with the housing pieces 18, 20, 22.

One of the features of the present invention is the use of both lateral sides of the bus bars to mount and entrap the bus bars between the housing pieces. Entrapping the bus bars in a suspended matter enables both sides of the bus bar to be used. This results in a much smaller electrical power connection block. This can take up less space on the member E. This invention can allow a method of making a factory connection at an OEM that enables the end user to make the power connection with a reliable lug terminal. The two pole lug block body described above consists of merely three molded plastic component housing pieces that interlock with each other trapping the two bus bars suspended in between them. The present invention uses the lateral sides of the bus bars as mounting ears for the bus bars. This can reduce the overall size of the connection block. If a three poll installation is required, then an additional center block 20 and bus bar can be used side by side with the other components.

Another one of the features of the present invention is in regard to the interlocking and keying nature of the interlock connection sections 25, 64, 66 and 110. As noted above, the projections 68 and 70 have different lateral lengths. Likewise, the recesses 32, 34 have different lateral lengths. Thus, when the housing pieces 18, 20 and 22 are connected to each other even if the housing pieces are not precisely flush against each other the overlapping nature of the housing pieces prevent air gaps at the seams between the top side of the bottom sections and the bottom sides of the bottom sections. This prevents a possible incorrect air clearance and oversurface clearance between the bus bars and the member E. However, in alternate embodiments, any suitable type of overlapping of the housing pieces at their connection could be provided.

Figure 9:
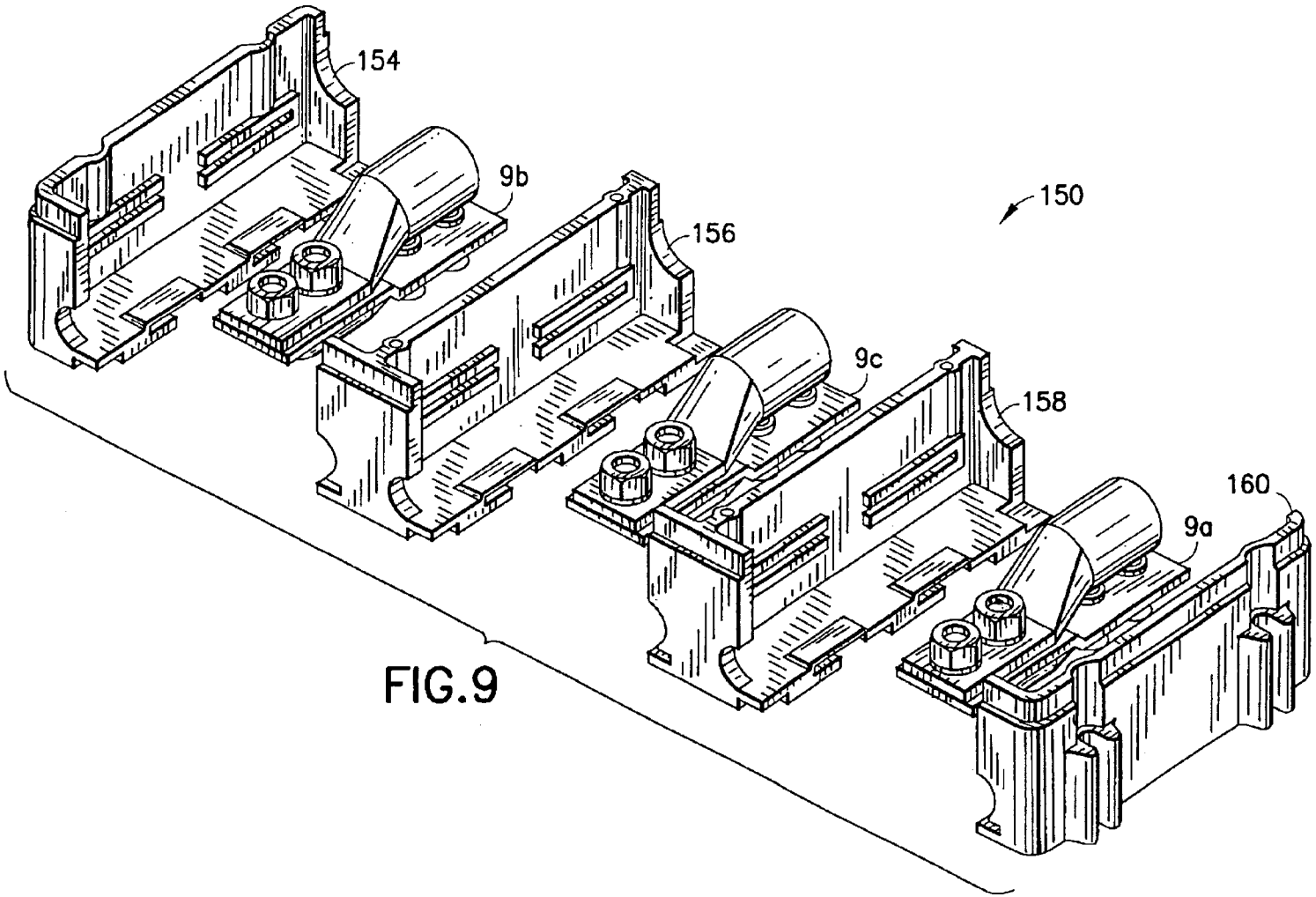
FIG. 9 is an exploded perspective view of an alternate embodiment of the present invention.

Another feature of the present invention is in regard to the modular design of the housing pieces 18, 20 and 22. The housing pieces are easily assembled without any special tools. The keying nature of the interlock connection sections 25, 64, 66 and 110 prevent the housing pieces from being incorrectly assembled relative to each other. Referring also to FIG. 9, an alternate embodiment of the electrical power connection block is shown. The embodiment shown is for a three poll connection. Thus, the connection block 150 comprises three electrical bus bars 9*a*, 9*b* and 9*c*, and connection block housing 152.

In this embodiment, the connection block housing 152 generally comprises a first housing piece 154, a second housing piece 156, a third housing piece 158 and a fourth housing piece 160. The first housing piece 154 is identical to the first housing piece 18 of the embodiment shown in FIGS. 1–7. The fourth housing piece 160 is identical to the third housing piece 22 of the embodiment shown in FIGS. 1–7. The second housing piece 156 and the third housing piece 158 are identical to each other. The second and third housing pieces 156, 158 are identical to the second housing piece 20 of the embodiment shown in FIGS. 1–7.

Thus, three housing piece components can be used to form a housing container for either a two pole situation, as in the embodiment shown in FIGS. 1-7, or a three poll situation as in the embodiment shown in FIG. 9. This can reduce manufacturing costs and inventory costs. For the three poll situation, a person assembling the housing components merely adds a second one of the middle housing pieces and an additional bus bar.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical power connection block housing comprising:

a first housing piece forming at least a portion of a first exterior side of the block housing, an interior side of the first housing piece having a first slot shaped bus bar mounting area; and a second housing piece connected to the first housing piece, the second housing piece having a portion with a first side located directly opposite the interior side of the first housing piece and a second slot shaped bus bar mounting area on the first side of the second housing piece, wherein the first and second housing pieces form a first bus bar receiving area with the first and second bus bar mounting areas located generally opposite each other on opposite sides of the receiving area for capturing opposite side edges of a bus bar therebetween, and wherein the first and second housing pieces each comprise interlock connection sections with mating projections and recesses which are intermeshed with each other, wherein the first and second housing pieces form conductor passage apertures through front and rear end walls of the connection block housing.

2. An electrical power connection block housing as in claim 1 wherein the first slot shaped bus bar mounting area comprises a first projection having a general C shape and extending inward from the interior side.

3. An electrical power connection block housing as in claim 2 wherein the first slot shaped bus bar mounting area comprises a second projection having a general reversed C shape and extending inward from the interior side.

4. An electrical power connection block housing as in claim 3 wherein the first and second projections are vertically offset from each other.

5. An electrical power connection block housing as in claim 1 wherein an exterior side of the first housing comprises fastener mounting areas.

6. An electrical power connection block housing as in claim 1 further comprising a third housing piece connected to the second housing piece, wherein the second housing piece has a second side opposite its first side, the second side of the second housing piece having a third slot shaped bus bar mounting area, and wherein the third housing piece has a first side located opposite the second side of the second housing piece, the first side of the third housing piece having a fourth slot shaped bus bar mounting area.

7. An electrical power connection block housing as in claim 6 wherein the third housing piece forms at least a portion of a second exterior side of the block housing, the second exterior side being located on an opposite side of the block housing from the first exterior side.

8. An electrical power connection block housing as in claim 6 further comprising a fourth housing piece to the third housing piece, wherein the third housing piece has a second side opposite its first side, the second side of the third housing piece having a fifth slot shaped bus bar mounting area, and wherein the fourth housing piece has a first side located opposite the second side of the third housing piece, the first side of the fourth housing piece having a sixth slot shaped bus bar mounting area.

9. An electrical power connection block housing as in claim 8 wherein exterior sides of the first and fourth housing pieces comprise fastener mounting areas.

10. An electrical power connection block housing as in claim 6 wherein exterior sides of the first and third housing pieces comprise fastener mounting areas.

11. An electrical power connection block housing as in claim 6 further comprising a cover connected to at least one of the housing pieces.

12. An electrical power connection block assembly comprising:

an electrical power connection block housing comprising:

a first housing piece comprising electrically insulating material forming at least a portion of a first exterior side of the block housing, an interior side of the first housing piece having a first slot shaped bus bar mounting area; and a second housing piece comprising electrically insulating material connected to the first housing piece, the second housing piece having a portion with a first side located directly opposite the interior side of the first housing piece and a second slot shaped bus bar mounting area on the first side of the second housing piece, wherein the first and second housing pieces form a first bus bar receiving area with the first and second bus bar mounting areas located generally opposite each other on opposite sides of the receiving area for capturing opposite side edges of a bus bar therebetween, and wherein the first and second housing pieces each comprise interlock connection sections with mating projections and recesses which are intermeshed with each other; and an electrical bus bar sandwiched between the first and second bus bar mounting areas, the mounting areas stationarily holding the bus bar in the first bus bar receiving area, wherein the electrical bus bar comprises a first section with at least one fastening post extending in a first direction and a second section with at least one fastening post extending in an opposite second direction.

13. An electrical power connection block assembly as in claim 12 wherein the first section is at least partially vertically offset from the second section.

14. An electrical power connection block assembly as in claim 13 wherein the first and second sections have a connecting section therebetween, and wherein the first, second and connecting sections form a general Z shape.

15. An electrical power connection block assembly as in claim 12 wherein the electrical bus bar comprises a first section with at least one fastener mounting hole and a second section with at least one fastener mounting hole.

16. An electrical power connection block assembly as in claim 15 wherein the first and second sections are vertically offset from each other.

17. An electrical power connection block assembly as in claim 15 wherein the at least one fastener mounting hole in the first section comprises an enlarged counter-bore section on a first side and, wherein the at least one fastener mounting hole in the second section comprises an enlarged counter-bore section on a second side.

18. An electrical power connection block assembly comprising:

an electrical power connection block housing comprising:

a first housing piece comprising electrically insulating material forming at least a portion of a first exterior side of the block housing, an interior side of the first housing piece having a first slot shaped bus bar mounting area; and a second housing piece comprising electrically insulating material connected to the first housing piece, the second housing piece having a portion with a first side located directly opposite the interior side of the first housing piece and a second slot shaped bus bar mounting area on the first side of the second housing piece, wherein the first and second housing pieces form a first bus bar receiving area with the first and second bus bar mounting areas located generally opposite each other on opposite sides of the receiving area for capturing opposite side edges of a bus bar therebetween, and wherein the first and second housing pieces each comprise interlock connection sections with mating projections and recesses which are intermeshed with each other; and an electrical bus bar sandwiched between the first and second bus bar mounting areas, the mounting areas stationarily holding the bus bar in the first bus bar receiving area, wherein the first and second bus bar mounting areas are spaced from top and bottom sides of the housing pieces to form through air clearances between the bus bar located in the first bus bar receiving area and the top and bottom sides of the housing pieces.

19. An electrical power connection block housing comprising:

a first housing piece forming at least a portion of a first side of the block housing, the first housing piece having a first interlock connection section;

a second housing piece having a first side with a second interlock connection section directly interconnected with the first interlock connection section and a second side with a third interlock connection section; and a third housing piece having a first side with a fourth interlock connection section directly interconnected with the third interlock connection section, wherein the housing pieces form bus bar receiving areas therebetween, and wherein the first and third interlock connection sections are substantially asame size and shape, and wherein the first interlock connection section comprises a side edge of a bottom section of the first housing piece having a bottom slot, a top slot located over the bottom slot and partially horizontally offset from the bottom slot, and cover section over the top slot.

20. An electrical power connection block housing as in claim 19 wherein the first housing piece has an interior facing side with a first bus bar side edge mounting section.

21. An electrical power connection block housing as in claim 20 wherein the second housing piece has a second bus bar side edge mounting section and a third bus bar side mounting section on respective opposite sides of the second housing piece.

22. An electrical power connection block housing as in claim 21 wherein the third housing piece has an interior side with a fourth bus bar side edge mounting section.

23. An electrical power connection block housing as in claim 21 further comprising a fourth housing piece connected to the third housing piece, wherein the fourth housing piece has an interior facing side with a bus bar side edge mounting section, and wherein the second housing piece and the third housing piece are substantially identical to each other.

24. An electrical power connection block housing as in claim 19 wherein the bottom slot extends into the side edge a further distance than the top slot.

25. An electrical power connection block housing as in claim 24 wherein the top and bottom slots are connected to each other.

26. An electrical power connection block housing as in claim 25 wherein the first interlock connection section comprises two pairs of the top slots, bottom slots and cover sections.

27. A method of assembling an electrical power connection block assembly comprising steps of:

locating electrical bus bars against at least three housing pieces of the connection block, a middle one of the housing pieces having two of the bus bars located against opposite respective sides of the middle housing piece; and intermeshing mating projections and recesses on a bottom section of the middle housing piece with adjacent ones of the housing pieces to interlock the housing pieces with each other, wherein the recesses comprise top slots and bottom slots connected to each other at the bottom section and horizontally offset from each other, and wherein the mating projections comprise top projections and bottom projections on the bottom section.

28. A method as in claim 27 wherein the step of locating the electrical bus bars between the pairs of housing pieces comprises sliding side edges of the bus bars into opposing receiving slots of mounting sections of the housing pieces.

* * * * *

UNITED STATES PATENT AND TRADEMARK OFFICE

CERTIFICATE OF CORRECTION

PATENT NO. : 6,814,628 B2
DATED : November 9, 2004
INVENTOR(S) : Chadbourne

It is certified that error appears in the above-identified patent and that said Letters Patent is hereby corrected as shown below:

Column 9,
Line 4, -- comprising electrically insulating material -- should be inserted after "piece" and before "forming".
Line 8, -- comprising electrically insulating material -- should be inserted after "piece" and before "connected".
Line 36, -- piece -- should be inserted after "housing" and before "comprises".
Line 54, -- connected -- should be inserted after "piece" and before "to".

Column 11,
Line 37, "asame" should be corrected to read -- a same --.

Column 12,
Line 3, -- edge -- should be inserted after "third bus bar side".
Line 42, "between the pairs of" should be deleted and -- against the -- should be inserted.

Signed and Sealed this

Eighth Day of February, 2005

JON W. DUDAS
*Director of the United States Patent and Trademark Office*